United States Patent [19]

Bailey et al.

[11] 3,938,327

[45] Feb. 17, 1976

[54] GAS GENERATOR

[76] Inventors: Leo L. Bailey; David R. Kimmel, both of Green Acres Mobile Estates, Lot 58, Avenue F, Lake Worth, Fla. 33460

[22] Filed: Feb. 4, 1974

[21] Appl. No.: 439,421

[52] U.S. Cl. ..... 60/39.77; 60/39.7

[51] Int. Cl.[2] ..... F02K 7/02; F02K 7/04

[58] Field of Search ..... 60/39.7, 39.71, 39.76, 60/39.78, 39.77, 260, 267, 247

[56] References Cited

UNITED STATES PATENTS

| | | | |
|---|---|---|---|
| 2,503,584 | 4/1950 | Lipkowski | 60/39.70 |
| 2,715,436 | 8/1955 | Lafferentz et al. | 60/39.71 |
| 2,731,795 | 1/1956 | Bodine | 60/39.77 |
| 2,745,861 | 5/1956 | Bodine | 60/39.77 |
| 2,838,102 | 6/1958 | Reimers | 60/39.77 |
| 2,937,500 | 5/1960 | Bodine | 60/39.77 |
| 3,005,310 | 10/1961 | Reder | 60/39.71 |
| 3,266,252 | 8/1966 | Hughes | 60/39.77 |
| 3,357,175 | 12/1967 | Fischbach | 60/39.69 |

FOREIGN PATENTS OR APPLICATIONS

| | | | |
|---|---|---|---|
| 117,220 | 10/1926 | Switzerland | 60/39.69 |
| 1,103,655 | 5/1955 | France | 60/39.7 |

*Primary Examiner*—Carlton R. Croyle
*Assistant Examiner*—L. J. Casaregola
*Attorney, Agent, or Firm*—Cushman, Darby & Cushman

[57] ABSTRACT

A gas generator comprises a combustion chamber, a gas storage chamber, a venturi tube joining the chambers, mechanism for supplying fuel to the combustion chamber via the venturi tube, a fuel igniter for igniting at least a portion of the fuel in the combustion chamber, and an outlet port in the combustion chamber for venting part of the expanding gases of combustion to provide a power output. The expanding gases of combustion expel a part of the unburned fuel to the storage chamber via the venturi tube for temporary storage and return to the combustion chamber via the venturi tube.

5 Claims, 5 Drawing Figures

GAS GENERATOR

BACKGROUND OF THE INVENTION

This invention relates to a gas generator for producing high pressure gas by burning expansible combustible material, and more particularly to a pulse type, multi-chamber gas generator which provides a flow of output gas for operating a turbine and the like by internally combusting fuel and air in at least one of the chambers.

Apparatus constructed according to the present invention has a pair of interconnected chambers, at least one of which comprises a combustion chamber utilized to burn at least a portion of the fuel introduced thereto. As the fuel is burned expanding gases are produced in the combustion chamber. A portion of the expanded gases is utilized to provide a useful power work output and another portion of the expanded gases is blown through a passage to a second chamber and forces unburned fuel in the combustion chamber into the second chamber. The pressure in the combustion chamber will lower so that the gas and unburned fuel in the second chamber will be redrawn into the combustion chamber. As the gas and unburned fuel pass between the chambers in the passage, additional fuel will be drawn into the chambers.

An object of the present invention is to provide a multi-chamber gas generator of the type described including a chamber-connecting passage having a throat of reduced cross section which is used as a venturi system to suck fuel into at least one of the chambers and pass gas and unburned fuel between the chambers.

When fuel is ignited in the combustion chamber, burning normally expands radially outwardly in all directions to produce an outwardly expanding fire ball. The high temperature, expanding gases of combustion, create an expanding high-pressure sphere which precedes the outwardly expanding flame front. The speed of expansion of the high-pressure sphere exceeds the speed of the flame front. This forces a substantial portion of unburned fuel to be expelled from the combustion chamber into the passage connecting the chambers before it has been consumed by the flame. When the unburned fuel is passed from the combustion chamber through the passage into the other chamber, the gas and fuel expelled into the passage must be cooled to prevent preignition of any fuel being sucked into the passage. Accordingly, it is an object of the present invention to provide a gas generator of the type described having a heat exchanger which cools the fuel being expelled from the combustion chamber below the flash point of the fuel.

The nature of the expanding flame front and the expanding gases makes the location of the outlet port and the igniter important. If the igniter were in the center of the chamber, unburned fuel would tend to be expelled through the outlet.

Another object of the present invention is to provide a multi-chamber gas generator of the type described including a combustion chamber, and an exhaust port in the combustion chamber positioned substantially diametrically opposite the passage which connects the chambers.

A further object of the present invention is to provide apparatus of the type described including heat exchanger mechanism in the passage for cooling expelled fuel below the flash point.

Other objects and advantages of the present invention will become apparent to those of ordinary skill in the art from the following description when considered in relation to the accompanying drawings, in which.

Figure 1:
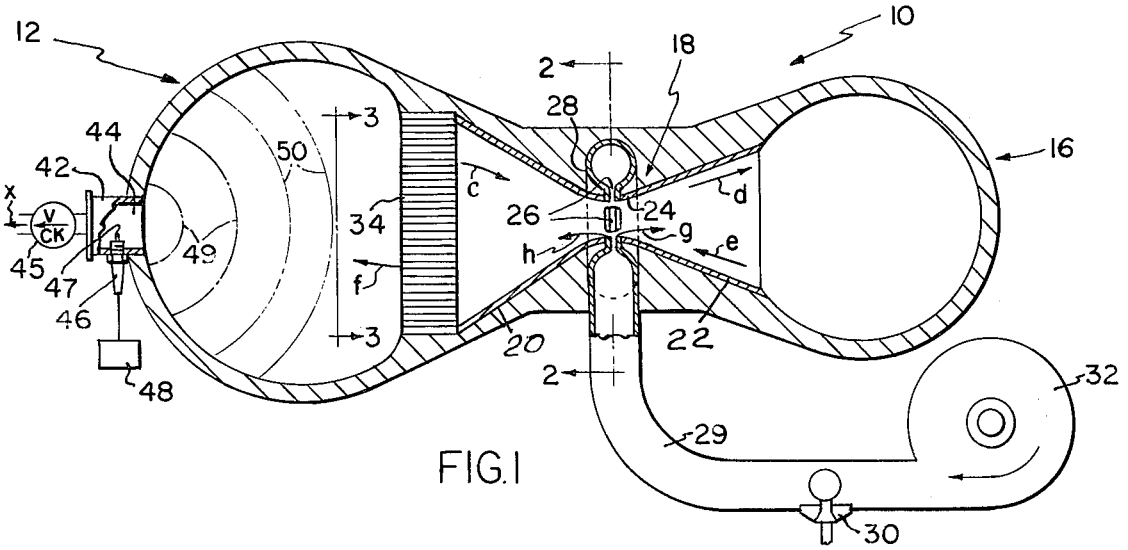
FIG. 1 is a sectional side view of a gas generator constructed according to a preferred embodiment of the invention.
Figure 2:
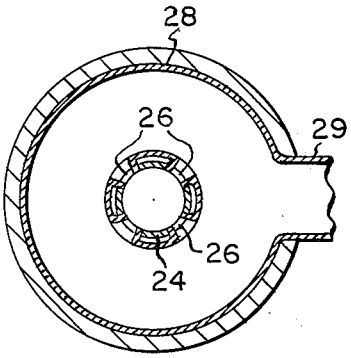
FIG. 2 is an enlarged, sectional end view taken along the line 2—2 of FIG. 1.
Figure 4:
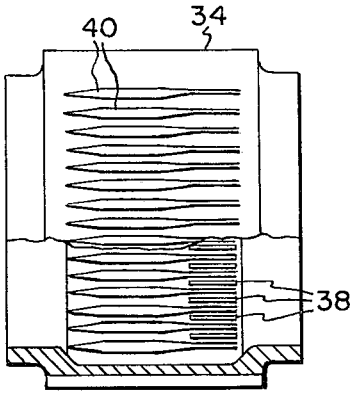
FIG. 4 is an enlarged, side elevational view of the heat exchange mechanism illustrated in FIG. 3.
Figure 3:
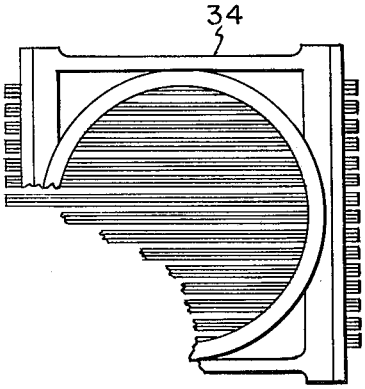
FIG. 3 is an enlarged view taken along the line 3—3 of FIG. 1, illustrating only the heat exchange mechanism.

Apparatus constructed according to the present invention comprises an elongate housing, generally designated 10, having a combustion chamber, generally designated 12, at one end and a reduced diameter reservoir chamber 16 at the opposite end joined by a venturi tube, generally designated 18. The venturi tube 18, which is cylindrical in cross section, includes axially outwardly flaring side wall portions 20 and 22 joined at a reduced diameter throat section 24. A coolant jacket (not shown) may be used to cool the housing 10, if desired.

A plurality of passages 26 constituting inlet ports are provided about the circumference of the throat section 24 and communicates with an annular cylinder 28 connected to a fuel supply tube 29. An atomizer 30 is connected to a tube 29 for injecting petroleum, such as a commercially available grade of gasoline having an octane rating of 91, into an airstream provided in the tube 29 by a blower 32 which is connected to the tube 29 for forcing the fuel and air mixture into the venturi tube 18 and combustion chamber 12. The fuel supply tube 29 could also be suitably connected to a source of ignitable powder, such as coal dust, entrained in an airstream. Heat exchange mechanism, generally designated 34, is provided in the venturi tube 29 adjacent the combustion chamber 12 and includes a plurality of vertically spaced, solid metal fins 38 and a plurality of interspersed, elongate, hollow tube-like fins 40 dispersed therebetween. A heat transfer medium is pumped through the tube-like fins 40.

An exhaust stack, generally designated 42, communicates with a port 44 provided in the combustion chamber 12 diametrically opposite the heat exchange member 34. A check valve 45 closes the stack 42 to atmosphere until the internal chamber pressure builds to a predetermined level at which time gas flows freely in the direction of the arrow *k*. It is important that the stack 42 and the outlet 44 have a substantially reduced cross section to insure proper gas flow through the venturi tube 18 and provide for proper air-fuel mixture induction as will later be more fully described. The reduced cross section also insures that a continuous outward or positive flow of gases will be provided although the flow might increase and decrease in pressure and volume. A spark plug 46 is provided in the stack 42 for igniting fuel in combustor 12 and is connected to a suitable source of power, schematically designated 48, for igniting fuel and causing gases therein to expand as represented at 50.

When an electric spark is produced between the electrodes 47 of the sparking device 46, the petroleum and air mixture in the immediate vicinity of the sparking device ignites. The heat given off by the burning fuel particles causes the adjacent particles to ignite so that a sphere-like flame front, starting from the spark plug 46, spreads through the combustion chamber as represented at 49. High pressure is built within the chamber 12 due to high temperature, expanding gases of combustion. The speed of expansion of the sphere of high pressure gases 50 exceeds the speed of expansion of the flame front 49. Consequently, the high pressure gases expand to expel unburned fuel through the heat exchanger 34 in the direction represented by the arrow *c*, before it has been consumed by the expanding flame front 49.

As the unburned fuel passes through the heat exchange mechanism 34 in the direction of the arrow *c*, the heat exchanger 34 accomplishes its primary function of cooling the fuel-air mixture being expelled from the combustion chamber 12 into the venturi tube 18 below the flash point of the unburned fuel. As the gases flowing in the direction of the arrow *c* pass through the restricted throat section 24, the velocity of the gases increases and the pressure decreases, causing fuel to be sucked into the venturi tube 18 from the fuel supply tube 29 and moved with the gases in the direction of the arrow *d* into the reservoir chamber 16. As the gas in the outlet stack 42 is vented and the pressure in the chamber 12 drops, the gases and fuel stored in the reservoir chamber 16 will be redrawn into the chamber 12.

As the gas and fuel in the reservoir chamber 16 returns in the opposite direction represented by the arrow *e*, it again creates a low pressure in the venturi tube 18 to suck in additional fuel from the tube 29 to be carried thereby to the combustion chamber 12 through the heat exchanger 34. As the stored fuel and newly admitted fuel pass through the heat exchanger 34, the heat exchanger 34 will again transfer much of the previously absorbed heat to the fuel entering the combustion chamber 12 in the direction of the arrow *f*. This is due to the fact that the temperature of the mixture of stored fuel and newly admitted fuel moving in the direction of arrow *f* is below the temperature of at least a portion of the heat exchange means which was previously heated due to the expulsion of the unburned fuel through the heat exchange means 34 in the direction of arrow *e*. The temperature in the mixture of stored fuel and newly admitted fuel, in some cases, being less due to additional heat transfer to the walls of chamber 16 and to the lower temperature of the fuel-air mixture being introduced in the venturi tube 18 through tube 29.

The powder product augmentor system, illustrated as a blower 32, will move added air into the chamber 12 to increase the pressure therein. The length of the supply tube 29 is adjustable so that it will resonate harmoniously with the static pause as the gas flow changes directions represented by the arrows *c*, *d* and *e*, *f*. This will tend to inhibit any back flow of fuel into the fuel supply tube 29. The high pressure node of the resonant wave will harmonize with the higher pressure condition at ports 26 due to the pause in the flow of gases. Apparatus, not shown, may be provided to change the effective diameter of the exhaust port 42 and the check valve 49 to achieve desired working pressures in the chamber 12.

THE OPERATION

It will be assumed that the combustion chamber 12 and the reservoir chamber 16 are charged with an ignitable fuel-air mixture. The spark plug 46 is energized to ignite the fuel-air mixture and an outwardly expanding flame front 49 is formed. Gases which are formed in the combustion chamber 12 by the combustion of the fuel builds and expands causing the pressure in the chamber 12 to build. Portions of the expanding gases are vented out the exhaust port 44, and the stack 42 and the check valve 45 as represented by the arrow *x*. The high pressure of the burning, expanding gases will force a larger portion of the combustion gases and unburned fuel in the combustion chamber 12 back through the heat exchanger 34 in the direction represented by the arrow *c*. The gases passed in the direction of the arrow *c* will suck additional fuel-air mixture into the venturi tube in the direction of the arrow *g*. The expelled gas, unburned fuel, and added fuel pass into the reservoir chamber 16. When the combustor 12 has partly exhausted the gases of combustion, the pressure in the combustor 12 will be lower than the pressure of the gases stored in the reservoir chamber 16. Gases will then flow in a reverse direction from the chamber 16 to the chamber 12. As these gases return through the throat 24, they will suck additional fuel-air mixture through the tube 29 as represented by the arrow *h*. This reverse flow of fuel and gas movement through the heat exchanger 34 into the chamber 12, forces any remaining spent, burned gases through the outlet 42 to provide a substantially continuous, positive, though pulsating flow of output gases. A portion of the stored and newly supplied fuel will be ignited by the ignition spark 46 and the cycle will be repeated.

ALTERNATE CONSTRUCTION

Figure 5:
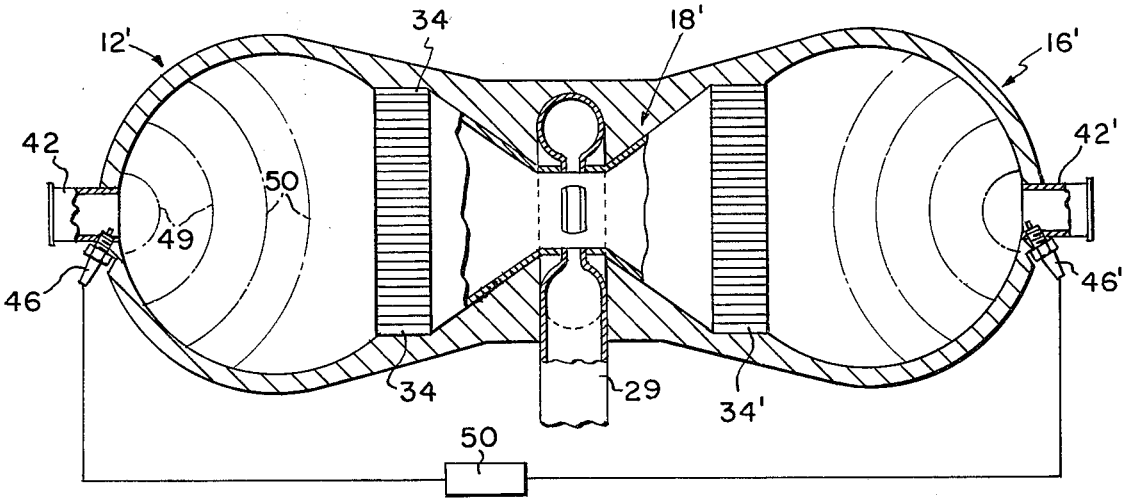
FIG. 5 is a longitudinal, sectional side view of a slightly modified construction.

A double acting system is illustrated in FIG. 5 and is generally similar to the system illustrated in FIGS. 1 – 4, except that the reservoir chamber 16 has been replaced by a combustion chamber 16', which is identical to the chamber 12, and includes a combustion gas venting stack 42' and a fuel igniting spark plug 46'. Heat exchangers 34 and 34' are mounted on opposite ends of the venturi tube 18' primarily for the purpose of cooling the fuel being blown back through the heat exchange members 34 and 34' by the expanding gases in the combustion chambers 12' and 16' respectively. A suitable electrical spark distributor, schematically designated 50, is provided to alternately energize the spark plugs 46 and 46'.

In the double acting generator illustrated in FIG. 5, 30% to 40% of the burning, expanding gas in either of the combustors 12', or 16' is expelled via the stacks 42 and 42' at the time of ignition in the form of burned hot gases or products of combustion. The other 60% to 70% of the gases are forced back through the heat exchange members 34 and 34' where they are cooled and used to create a low pressure gas flow through the venturi tube 18' to suck in new fuel and air via the supply tube 29'. The combustors 12 and 16' thus function as combustion chambers, as well as reservoir chambers, for receiving fuel expelled by the combustors 16' and 12', respectively. All of the fuel-air mixture not forced back through the heat exchangers 34 and 34' by the expanding gases of combustion is burned and exhausted out the exhaust port as an output product. Part of the output product is expelled during the high pressure stage by the expanding gases and part of the output product is expelled by the inrushing gas and fuel of the subsequent cycle.

The operation of the alternate embodiment is similar to the operation of the embodiment illustrated in FIG. 1. When ignition occurs in chamber 12', expanding gases of combustion pass out port 42 as previously described. The major portion of the unburned fuel and gases in chamber 12 are forced through the heat exchanger 34 where they are cooled below the flash point of the fuel entering the venturi tube 18' via the fuel supply tube 29'. The gases expelled into the venturi tube 18 create a low pressure that draws or siphons in more fuel from the supply tube 29'. This fuel passes through heat exchanger 34' where the expelled fuel and newly added fuel is heated and passed into the chamber 16'. The incoming gas and fuel forces out any previously burned gases in the chamber 16' to pass outwardly through the outlet stack 42'. The volume of the chamber relative to the volume of the gas entering is such that the pressure builds quickly, and then the spark plug 46' is fired to reverse the cycle.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

We claim:

1. A gas generator of the pulse jet type having at least one combustion chamber with an ignition device and an exhaust opening, the combustion chamber being connected to another chamber by a reduced venturi member for creating pulsed pressure and velocity differentials between the chambers due to the flow of partially combusted gases therethrough in phased relation so as to cause a fuel/air mixture to be introduced into at least one of the chambers through inlet port means located in the venturi member and mixed with the partially combusted gases, and so as to cause an exhaust of combusted gases through the exhaust opening, the improvement comprising:

heat exchange means disposed in the combustion chamber adjacent the venturi member and remote from the exhaust opening for removing heat from the partially combusted gases as they move from the combustion chamber through the venturi portion into the other chamber, said inlet port means being disposed in the venturi member between the heat exchange means and the other chamber, the heat removed being sufficient to bring the temperature of the partially combusted gases below the flash point of the fuel/air mixture being introduced into one of the chambers through the venturi member.

2. A gas generator as defined in claim 1, wherein the heat exchange means supplies at least a portion of the heat previously removed from the partially combusted gases as they flowed from the combustion chamber to the other chamber, to the partially combusted gases which have been combined with the fuel/air mixture in the venturi member, the heat being supplied as the partially combusted gases and fuel/air mixture move through the heat exchange means from the other chamber into the combustion chamber.

3. A gas generator of the pulse jet type wherein a plurality of chambers, at least one of which is a combustion chamber having an ignition device and an exhaust opening, are provided interconnected by a venturi member for creating pulsed pressure and velocity differentials between the chambers due to the flow of partially combusted gases therethrough in phased relation so as to cause a fuel/air mixture to be introduced into at least one of the chambers through inlet port means located in the venturi member and mixed with the partially combusted gases and so as to cause an exhaust of the partially combusted gases through the exhaust opening, the improvement comprising:

heat exchange means disposed in the at least one combustion chamber adjacent the venturi member and remote from the exhaust opening in the at least one combustion chamber, said inlet port means being disposed in the venturi member between the heat exchange means and another of the chambers, the heat removed being sufficient to bring the temperature of the partially combusted gases below the flash point of the fuel/air mixture being introduced.

4. A gas generator as defined in claim 3, wherein there are two combustion chambers interconnected by the venturi member, each combustion chamber containing heat exchange means disposed adjacent the venturi member and remote from the exhaust opening in each chamber.

5. A gas generator as defined in claim 3, wherein the heat exchange means supplies at least a portion of the heat previously removed from the partially combusted gases as they flowed from one of the two combustion chambers to the other combustion chamber, to the partially combusted gases which have been combined with the fuel/air mixture introduced in the venturi member, as the partially combusted gases and fuel/air mixture move from the other combustion chamber into the one combustion chamber.

* * * * *